US006665233B2

(12) United States Patent
Cosgrove

(10) Patent No.: US 6,665,233 B2
(45) Date of Patent: Dec. 16, 2003

(54) ELECTRONIC TIMEKEEPING AND BROADCASTING DEVICE AND METHOD OF USE

(76) Inventor: Chris Cosgrove, 8508 7th St., Downey, CA (US) 90241

( * ) Notice: Subject to any disclaimer, the term of this patent is extended or adjusted under 35 U.S.C. 154(b) by 157 days.

(21) Appl. No.: 09/954,554

(22) Filed: Sep. 17, 2001

(65) Prior Publication Data

US 2003/0053376 A1 Mar. 20, 2003

(51) Int. Cl.[7] ..... G04B 47/00; G04B 21/08; A47C 20/02

(52) U.S. Cl. ..... 368/10; 368/63; 5/639

(58) Field of Search ..... 368/10, 12, 63, 368/72–74, 243; 5/634, 635, 940

(56) References Cited

U.S. PATENT DOCUMENTS

| | | | | | |
|---|---|---|---|---|---|
| 2,958,769 | A | | 11/1960 | Bounds | 250/14 |
| 3,644,682 | A | | 2/1972 | Parilla | 179/100.1 |
| 3,998,045 | A | | 12/1976 | Lester | 58/23 |
| 4,221,975 | A | | 9/1980 | Ledniczki et al. | 307/116 |
| 4,525,076 | A | * | 6/1985 | Takebe | 368/63 |
| 4,531,841 | A | | 7/1985 | Puff | 368/63 |
| 4,763,369 | A | | 8/1988 | Spector | 5/434 |
| 4,894,813 | A | | 1/1990 | Pächer et al. | 368/256 |
| 4,972,533 | A | * | 11/1990 | Brown | 5/413 |
| 5,072,429 | A | | 12/1991 | Mair | 368/10 |
| D327,802 | S | | 7/1992 | Downing | D6/601 |
| D331,520 | S | | 12/1992 | Ruddy | D6/601 |
| 5,179,747 | A | | 1/1993 | Zink | 5/639 |
| 5,511,046 | A | * | 4/1996 | Vanderpal | 368/63 |
| 5,778,468 | A | | 7/1998 | Saarela et al. | 5/636 |
| 6,081,949 | A | | 7/2000 | Delicia | 5/639 |
| 6,236,621 | B1 | | 5/2001 | Schettino | 368/10 |

* cited by examiner

*Primary Examiner*—Vit Miska
(74) *Attorney, Agent, or Firm*—Cislo & Thomas LLP

(57) ABSTRACT

An electronic timekeeping and broadcasting device for use near a user's ear while resting includes a cover portion with a speaker inside the cover, a digital voice synthesizer connected to the speaker, and an electronic clock connected to the synthesizer, and a switch connected to the synthesizer, and includes a power supply. Upon turning on the switch and activating the synthesizer, the time is broadcast from the speaker. The device enables a resting user to learn the time with the least possible effort, not even having to move his or her head or open his or her eyes.

16 Claims, 1 Drawing Sheet

ELECTRONIC TIMEKEEPING AND BROADCASTING DEVICE AND METHOD OF USE

BACKGROUND OF THE INVENTION

1. Field of the Invention

This invention relates generally to electronic timekeepers, and more particularly to a small device attachable to bedding that broadcasts the time upon the user signaling the device.

2. Description of the Related Art

Electronic timekeeping devices such as alarm clocks or other wake up devices are well known. Generally, these devices display the time in a visual format, and include alarms to alert the user when a certain time of day is reached. Such alarms may be audible, for example a buzzer, bell or the like, or even turning on of a radio. Snooze features that turn off the alarm and reset it to come on again in approximately ten minutes are very popular.

There are certain problems with such conventional alarm clocks, however. Oftentimes users want to know the time, which requires considerable effort of having to move one's body or head, open one's eyes, and focus on a lighted alarm clock display. In some situations it would be preferable if the user could simply touch a device in a known place, in close proximity to him or her, and have the time conveyed in a non-visual manner.

Talking wall clocks or timepieces have also been known. Heretofore such devices were generally limited to educating children in an entertaining way as to telling time, or aiding persons with vision losses unable to read conventional clocks or wrist watches. Most persons prefer not to wear a wristwatch to bed, however, nor have a wall clock located near them while sleeping.

SUMMARY OF THE INVENTION

An electronic timekeeping and broadcasting device for use near a user's ear while resting includes a cover portion with a speaker inside the cover, a digital voice synthesizer connected to the speaker, an electronic clock connected to the synthesizer, and a switch connected to the synthesizer, and includes a power supply. Upon turning on the switch and activating the synthesizer, the time is broadcast from the speaker. The device enables a resting user to learn the time with the least possible effort.

As required, an amplifier may be added in electrical connection with the digital voice synthesizer and the speaker, as well as a volume control circuit. By way of examples, the switch may include a pressure or touch sensor or other types of sensors, or a simple conventional mechanical switch.

The cover is preferably padded, and attachable to the bedding of the user. The cover preferably includes an opening to gain access to the device. The power source is preferably a conventional battery located inside the cover. Optionally, the device may be powered by alternating current from a nearby electrical outlet.

Inside the electronic clock preferably includes a controller for changing the time. The voice synthesizer is preferably capable of producing a plurality of different voices, and includes a controller for changing between the different voices.

OBJECTS OF THE INVENTION

It is an object of the invention to provide a device enabling the time to be requested and audibly conveyed with the minimum amount of effort required by a resting user.

It is a further object of the present invention to provide an electronic timepiece that upon command conveys the time to the user though non-visual means.

It is a further object of the invention that the electronic timepiece broadcast the time by voice upon a sensor receiving the user's desire for the information.

These and other objects and advantages of the present invention will become apparent from a review of the following description and accompanying drawings.

DESCRIPTION OF THE PREFERRED EMBODIMENT(S)

Figure 1:
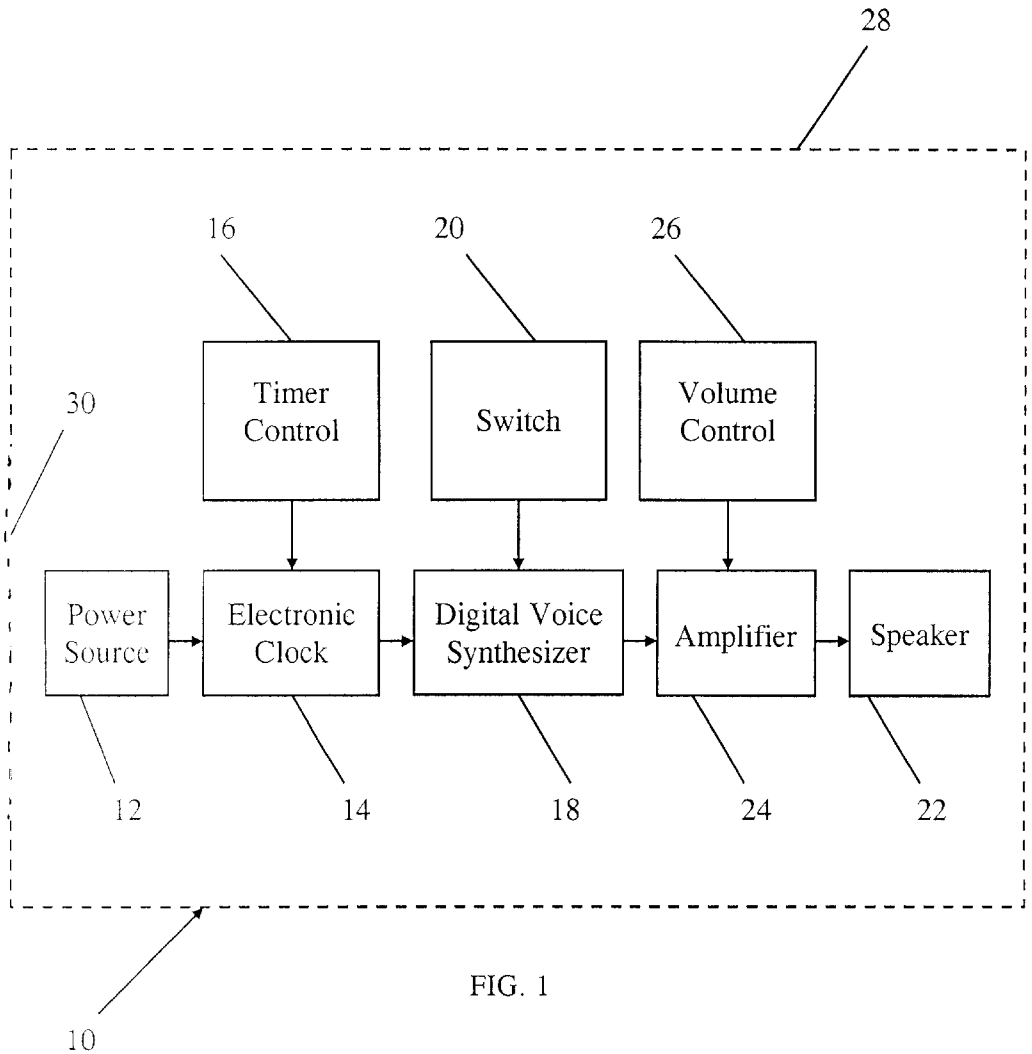
FIG. 1 is a block diagram showing the components of a preferred embodiment of the invention.

The detailed description set forth below in connection with the appended drawings is intended as a description of presently-preferred embodiments of the invention, and is not intended to represent the only forms in which the present invention may be constructed and/or utilized. The description sets forth the structure and the sequence of steps for constructing and operating the invention in connection with the illustrated embodiments. It is to be understood, however, that the same or equivalent structures and steps may be accomplished by different embodiments that are also intended to be encompassed within the spirit and scope of the invention.

An electronic timekeeping and broadcasting device 10 includes a power source 12, preferably direct current conventional batteries. Optionally, the power source 12 may be alternating current from a nearby electrical outlet, or in some other manner. Electrically connected to the power source 12 is a conventional digital electronic clock 14 that keeps track of the time of day, in hours (a.m. or p.m.) and minutes. The electronic clock 14 preferably includes a timer control 16 should it be necessary to adjust the time of the electronic clock 14.

The electronic clock 14 is electrically connected to a conventional digital voice synthesizer 18, that is electrically connected to a switch 20. The synthesizer 18 receives digital signals from the electronic clock 14 and converts the same into an analog signal. Electrically connected to the synthesizer 18 is a conventional small speaker 22. An amplifier 24 between the synthesizer 18 and speaker 22 is likely required to increase the amplitude of the analog signal. A conventional volume control circuit 26 is preferably included as well. The synthesizer 18 could also optionally include multiple voices including a whisper, and a controller (not shown) to select among the same.

The switch 20 for the synthesizer 18 is preferably responsive to pressure on the device 10, i.e. by pressing on either side of the device 10 the switch 20 is activated. Alternatively, the switch 20 may be touch activated, e.g. by movement of a human finger along a control surface. Optionally, the switch 20 could include a controller (not shown) to adjust the sensitivity of the switch 20 to the external input. Obviously, but less advantageously, a simple conventional mechanical on-off switch 20 would suffice as well.

The electronic device 10 is enclosed in a cover 28. The cover 28 is preferably fabricated of a padded insulated material, with an opening 30 to gain access inside. The opening 30 preferably includes corresponding Velcro® fastening strips (not shown). The cover 28 is preferably attachable to bedding of a user, e.g. to the user's pillowcase. The attachablity is preferably accomplished by a soft, clothespin-like structure (not shown). Alternatively, there are numerous other ways the cover could be attached, e.g. with a safety-pin-like structure, corresponding strips of Velcro®, or the like.

Operation of the device 10 is as follows. The cover 28 would be opened and conventional batteries 12 would be loaded into the device 10. The electronic clock 14 would be set to the correct time using the timer controller 16. Upon applying pressure or otherwise activating the switch 20, the voice synthesizer 18 would be turned on and receive the digital signal from the electronic clock 14 and convert the same into an analog signal. The analog signal would pass through the amplifier 24, subject to the volume control 26. The correct time would be broadcast through the speaker 22.

While the present invention has been described with regards to particular embodiments, it is recognized that additional variations of the present invention may be devised without departing from the inventive concept.

What is claimed is:

1. A timekeeping device attachable to bedding and for use in close proximity to the user's ear while resting comprising:

a speaker;

a digital voice synthesizer in electrical communication with said speaker operably configured to generate a minimally obtrusive announcement of time;

an electronic clock registering time and in electrical communication with said synthesizer;

a power source in electrical communication with said device;

a cover portion enclosing said speaker, digital voice synthesizer, electronic clock, and power source, said cover portion being attachable to the bedding; and, an activation switch enclosed within said cover portion, in electrical communication with said synthesizer for discrete user-prompted activation thereof, said activation switch being actuable responsive to user manipulation of said cover portion;

where upon turning said switch on and activating said synthesizer the time is broadcast from said speaker.

2. The timekeeping device of claim 1 further comprising an amplifier in electrical communication with said digital voice synthesizer and said speaker.

3. The timekeeping device of claim 1 wherein said switch comprises a touch sensor.

4. The timekeeping device of claim 1 wherein said switch comprises a pressure sensor.

5. The timekeeping device of claim 1 wherein said cover portion is padded.

6. The timekeeping device of claim 2 further comprising a volume control circuit in electrical communication with said amplifier.

7. The timekeeping device of claim 1 wherein said power source comprises a conventional battery.

8. The timekeeping device of claim 1 wherein said battery is located inside said power portion.

9. The timekeeping device of claim 1 wherein said power source comprises alternating current from an electrical outlet.

10. The timekeeping device of claim 1 wherein said cover portion comprises an opening to gain access to said device inside said cover portion.

11. The timekeeping device of claim 1 wherein said electronic clock comprises a controller for changing the time.

12. The timekeeping device of claim 1 wherein said voice synthesizer is capable of producing a plurality of different voices.

13. A method for providing the time to a user while resting comprising:

providing a timekeeper device comprising:

a digital voice synthesizer operably configured to generate a minimally obtrusive announcement of time;

an electronic clock registering time and in electrical communication with said synthesizer;

a cover portion enclosing said digital voice synthesizer and electronic clock; and, an activation switch enclosed within said cover portion, in electrical communication with said synthesizer for discrete user-prompted activation thereof, said activation switch being actuable responsive to user manipulation of said cover portion;

attaching said cover portion of said timekeeping device to the user's bedding;

transducing a user-prompt to actuate said timekeeping device to provide the time; and, audibly broadcasting the time from said timekeeping device.

14. The method of claim 13 wherein the signaling is by the user touching said timekeeping device.

15. The method of claim 14 wherein the signaling is by the user applying pressure to said timekeeping device.

16. The method of claim 13 wherein said cover portion is detachably attached to a pillowcase.

* * * * *